US005542850A

United States Patent [19]

Frantz

[11] Patent Number: 5,542,850

[45] Date of Patent: Aug. 6, 1996

[54] PIVOTAL ELECTRICAL CONNECTOR

[75] Inventor: Robert H. Frantz, Newville, Pa.

[73] Assignee: The Whitaker Corporation, Wilmington, Del.

[21] Appl. No.: 268,756

[22] Filed: Jun. 30, 1994

[51] Int. Cl.[6] ..... H01R 39/00

[52] U.S. Cl. ..... 439/31; 439/12

[58] Field of Search ..... 439/341, 11, 12, 439/13, 18, 20, 28, 29, 30, 31

[56] References Cited

U.S. PATENT DOCUMENTS

| | | | |
|---|---|---|---|
| 1,255,248 | 2/1918 | Toll . | |
| 3,601,746 | 8/1971 | Teagno | 439/31 |
| 3,691,430 | 9/1972 | Freitag | 317/101 DH |
| 3,785,049 | 1/1974 | Kanamaru et al. | 29/629 |
| 3,902,775 | 9/1975 | Speller | 339/5 P |
| 4,003,616 | 1/1977 | Springer | 339/8 R |
| 4,128,289 | 12/1978 | Occhipinti | 339/75 MP |
| 4,533,796 | 8/1985 | Engelmore | 179/186 |
| 4,547,027 | 10/1985 | Scheibenreif | 339/8 R |
| 4,558,911 | 12/1985 | Ruoff | 339/5 M |
| 4,583,797 | 4/1986 | Engelmore et al. | 339/6 R |
| 4,632,475 | 12/1986 | Tomita | 439/31 |
| 4,657,320 | 4/1987 | Bamford et al. | 439/31 |
| 4,673,228 | 6/1987 | Ditzig | 439/21 |
| 4,701,133 | 10/1987 | Worth | 439/13 |
| 4,715,819 | 12/1987 | Iwasa et al. | 439/31 |
| 4,731,030 | 3/1988 | Johnston | 439/6 |
| 4,764,121 | 8/1988 | Ditzig | 439/21 |
| 4,843,223 | 6/1989 | Shino | 235/487 |
| 4,850,882 | 7/1989 | Yu | 439/31 |
| 4,863,388 | 9/1989 | Reimer et al. | 439/31 |
| 4,865,553 | 9/1989 | Tanigawa et al. | 439/31 |
| 4,877,409 | 10/1989 | Tanigawa et al. | 439/31 |
| 4,975,062 | 12/1990 | Evans et al. | 439/13 |
| 5,013,224 | 5/1991 | Liao | 417/423.5 |
| 5,074,796 | 12/1991 | Carter | 439/24 |
| 5,106,306 | 4/1992 | Ditzig | 439/26 |
| 5,139,281 | 8/1992 | Dzioba | 280/775 |
| 5,168,429 | 12/1992 | Hosoi | 361/395 |
| 5,178,546 | 1/1993 | Dickerson | 439/13 |
| 5,233,502 | 8/1993 | Beatty et al. | 361/729 |
| 5,234,347 | 8/1993 | Kang | 439/26 |
| 5,237,488 | 8/1993 | Moser et al. | 361/729 |
| 5,238,421 | 8/1993 | Kobayashi | 439/165 |
| 5,240,427 | 8/1993 | Kobayashi | 439/165 |
| 5,253,139 | 10/1993 | Satou | 361/681 |

FOREIGN PATENT DOCUMENTS

| | | |
|---|---|---|
| 475276 | 7/1990 | Japan . |

*Primary Examiner*—David L. Pirlot

[57] ABSTRACT

A pivotal plug and receptacle connector assembly (10) is disclosed. The plug housing (40) has an opening (48) at each end formed integral thereto that engage hinge pins (142,144) extending from opposite ends of the mating receptacle housing (100). The hinge pins are arranged to snap into place within the openings and allow for relative pivotal motion of 180 degrees while maintaining electrical contact between the plug contacts (60) and the receptacle contacts (118). The plug contacts are blade shaped having two contacting surfaces (70,72) on opposite sides of the blade (64). The receptacle contacts include a pair of substantially parallel beams (122,124) having opposing contact surfaces (135, 137) adjacent their ends, the two beams converging slightly near their ends (132,134) to provide two point contact with a mated plug contact (60). The plug and receptacle connectors are easily mated and separated during use.

15 Claims, 5 Drawing Sheets

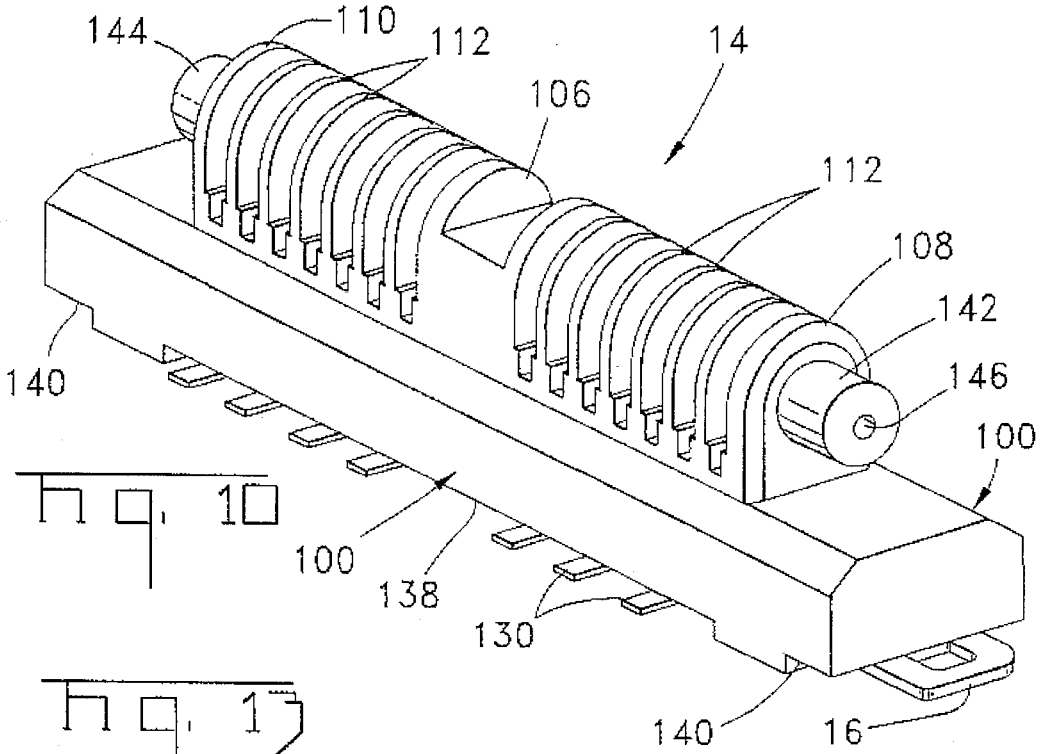
Fig. 10
Fig. 13
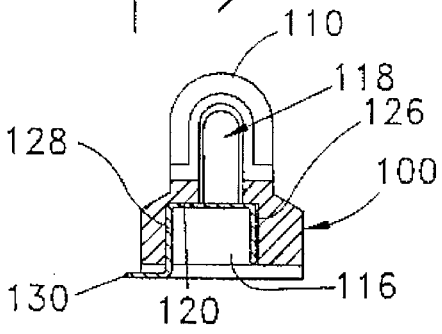
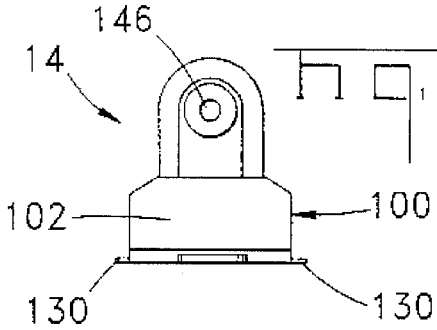
Fig. 12
Fig. 11
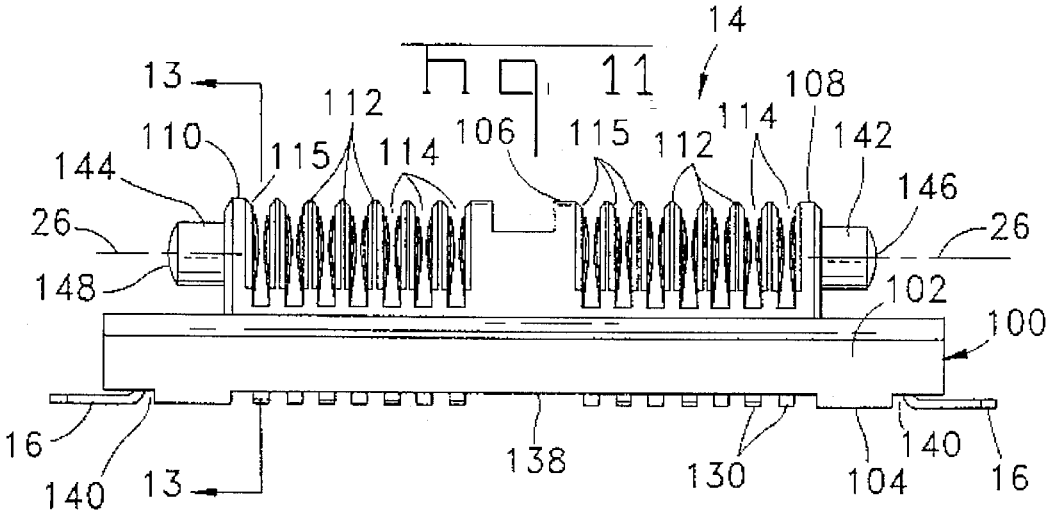

PIVOTAL ELECTRICAL CONNECTOR

The present invention relates to electrical connectors of the type that interconnect circuitry contained in two separate electrical units that are pivotally connected together such as a keyboard and a display unit in a laptop computer.

BACKGROUND OF THE INVENTION

Portable computers such as lap-top and notebook type computers are characterized by a system unit which contains the CPU, disk drives, memory and other hardware, and a display unit which is pivotally attached to the system unit. Necessarily, the display unit is also electrically interconnected with the system unit by means of a flexible cable, a slip ring arrangement, or a pivotable electrical connector. Flexible cables are well known for suffering fatigue in such environments resulting in broken conductors that render the equipment unreliable or inoperative. Slip ring systems, on the other hand, are reliable but expensive to manufacture and require a substantial amount of space to implement. A pivotal connector, on the other hand, does not have these shortcomings and, as will be explained below, can have certain advantages such as easy installation or replacement. A pivotal connector may be integrated into the hinge structure of the computer or it may be a separate connector attached to the computer so that its pivot is axially aligned with the hinge. An example of the interconnection being integrated into the hinge is disclosed in U.S. Pat. No. 5,237,488 which issued Aug. 17, 1993 to Moser et al. There, the hinge pin itself has conductive tracks in the form of slip rings on its outer surface while the system and display units have conductive wipers that are in contacting engagement with the slip rings so that, as the display unit is pivoted about the hinge pin, electrical interconnection through the slip rings is maintained. Since the electrical connector is an integral part of the computer, it is difficult to repair or replace. Separate pivotal connectors, on the other hand, overcome this problem, and additionally have the advantage of being less expensive to manufacture. Such a separate pivotal connector is disclosed in U.S. Pat. No. 4,865,553 which issued Sep. 12, 1989 to Tanigawa et al. The '553 patent shows a receptacle connector having a U-shaped contact and a mating plug connector having a contact with a cylindrical portion that engages the U-shaped contact, making electrical contact on opposite points on its outer cylindrical surface. Such a cylindrical shaped contact having two points of contact is quit reliable but relatively expensive to manufacture. Another example of a separate pivotal connector is disclosed in U.S. Pat. No. 4,975,062 which issued Dec. 4, 1990 to Evans et al. The '062 patent discloses a connector having identical mating connector halves, each having identical contacts. The connector housings have a complementary hinge pin and hole so that when mated, the pin of one housing pivotally engages the hole of the other housing. The contacts are stamped and formed, each having a flat contact surface supported in the center of a beam that deflects when the contact mates with its corresponding mating contact. All of the contact force is provided by the single deflecting beam. While such a contact structure is suitable for many electrical applications, with only one point of contact, its reliability may suffer when used in environmental conditions conducive to contamination.

What is needed is a pivotal electrical connector that utilizes two point contacts with relatively high reliability yet is inexpensive to manufacture and is easily installed and replaced in the field.

SUMMARY OF THE INVENTION

A first electrical connector arranged to matingly engage a second electrical connector is disclosed. The first connector includes an insulating housing with a base portion having a plurality of cavities therein. The connector has a longitudinal axis spaced from the base portion. A plurality of contacts are provided, each having first and second contact faces for mating engagement with a respective contact of the second connector. The contacts are arranged so that one contact is in each cavity and extends from the base portion outwardly so that the contact faces are substantially perpendicular to and intersected by the axis. A hinge portion is provided having a hinge pivot that is coaxial with the axis and arranged so that when the first connector is in mated engagement with the second connector, the first connector is pivotable with respect to the second connector about the axis through a specific angle while continuously maintaining mated engagement.

DESCRIPTION OF THE FIGURES

FIG. 3 is an isometric view of the plug connector shown in FIG. 1;

FIGS. 8 and 9 are front and side views, respectively, of the plug contact;

FIG. 10 is an isometric view of a receptacle connector shown in FIG. 1;

FIG. 11 is a front view of the receptacle connector;

FIG. 12 is an end view of the receptacle connector;

FIG. 13 is a cross-sectional view taken along the lines 13—13 of FIG. 11;

DESCRIPTION OF THE PREFERRED EMBODIMENT

Figure 1:
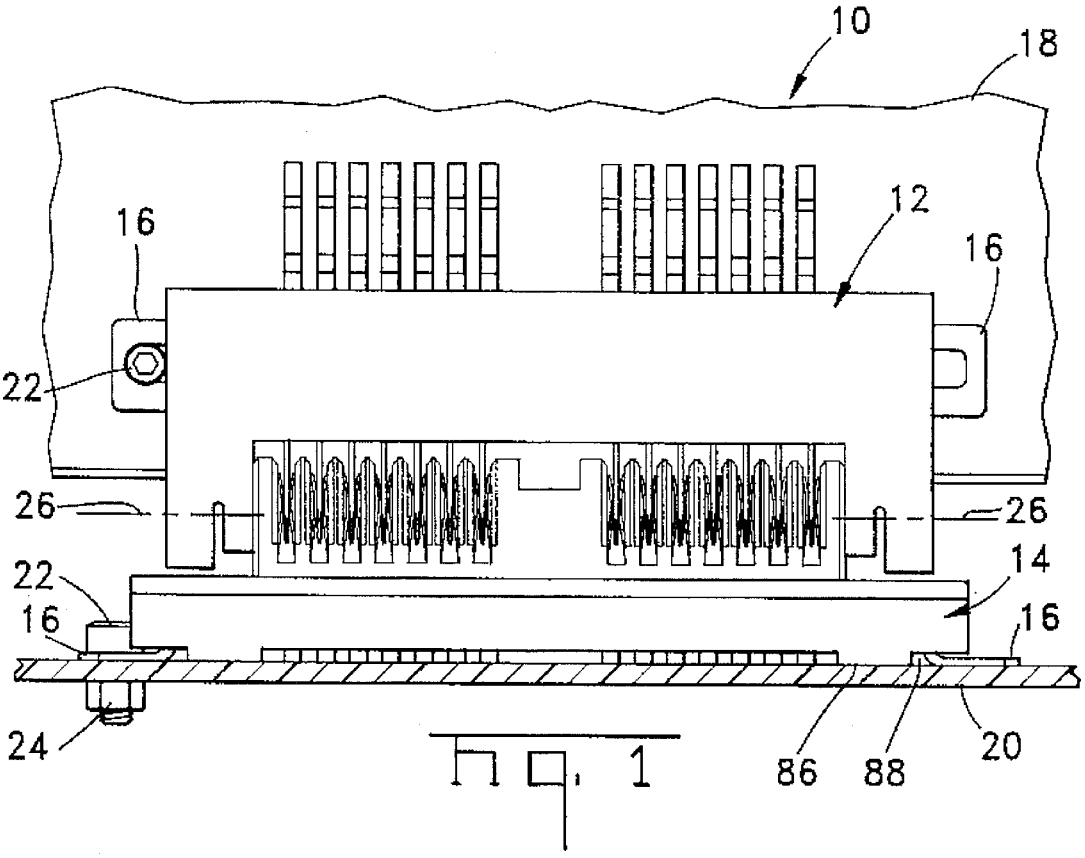
FIG. 1 is a front view of a pivotal connector assembly incorporating the teachings of the present invention.
Figure 2:
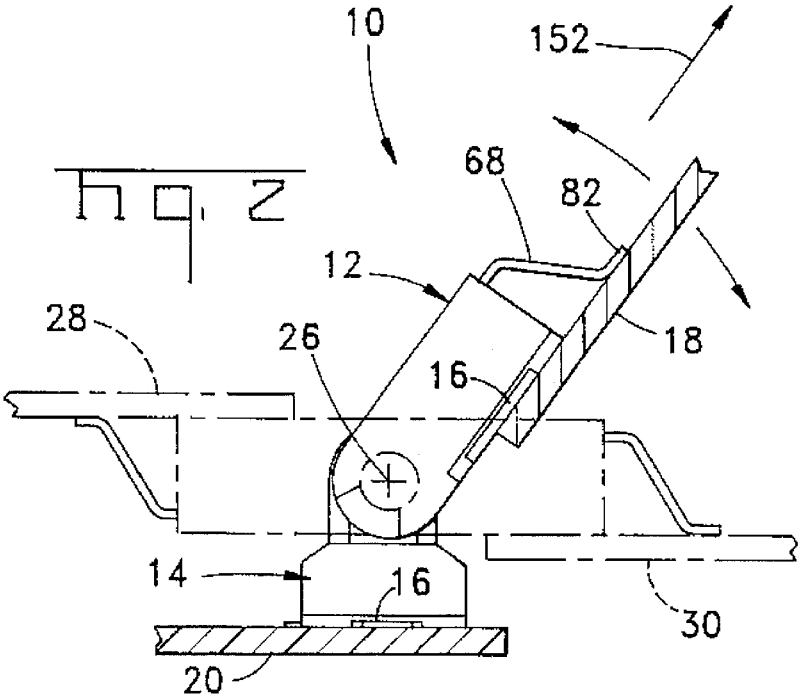
FIG. 2 is an end view of the connector assembly shown in FIG. 1.

There is shown in FIGS. 1 and 2 a pivotal electrical connector assembly 10 having a plug connector 12 and a mating receptacle connector 14. The plug and receptacle connectors 12 and 14 include mounting clips 16 that are used to secure the connectors to circuit boards 18 and 20, respectively, by means of screws 22 and nuts 24 in the usual manner. The connector 10 has a longitudinal axis 26 that is parallel to the two circuit boards 18 and 20. The plug connector 12 is pivotally mated to the receptacle so that it is pivotable about the longitudinal axis 26 for a full 180 degrees indicated by the phantom lines 28 and 30 in FIG. 2. The mated contact of the two connectors remain in electrically mated engagement during the full 180 degrees of pivotal movement.

Figure 6:
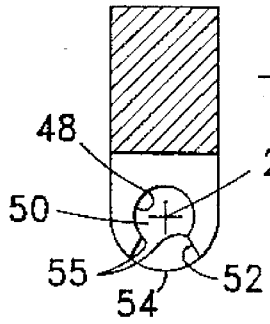
FIG. 6 is a cross-sectional view taken along the lines 6—6 in FIG. 4.
Figure 4:
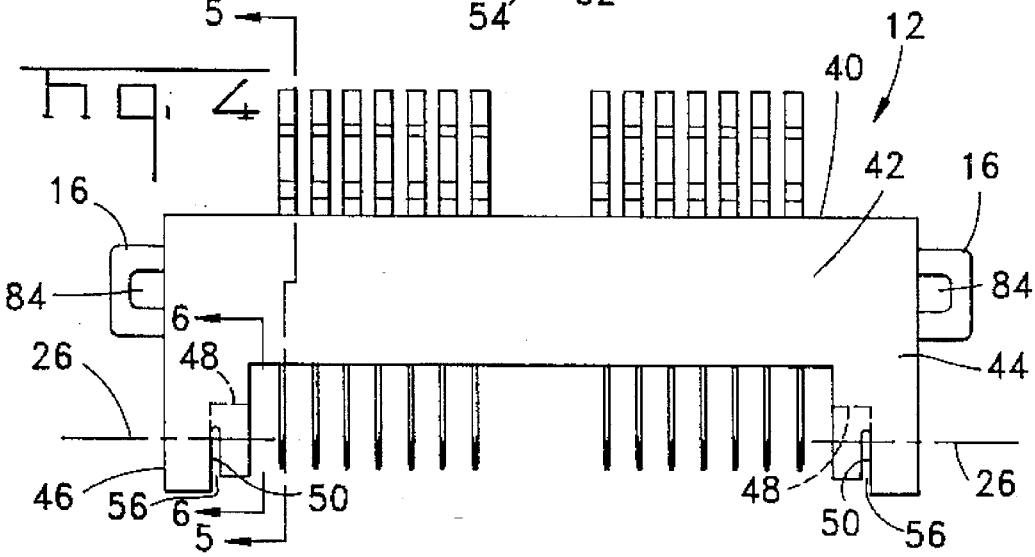
FIG. 4 is a front view of the plug connector.
Figure 7:
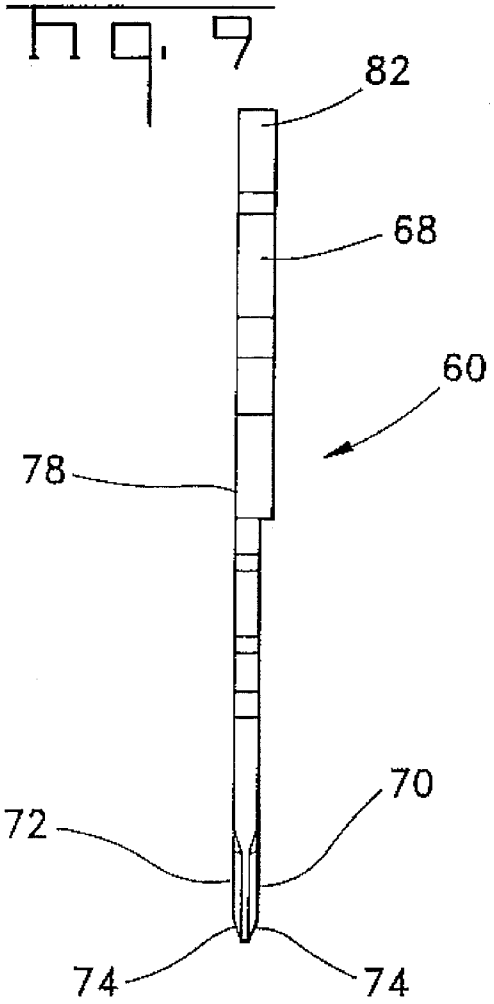

The plug connector 12, shown in FIGS. 3 through 6, includes an insulating plug housing 40 having a base portion 42 and right and left flanges 44 and 46, respectively, extending from the base portion. As best seen in FIGS. 4 and 6, a cylindrically shaped opening 48 with a bottom surface 50 is formed in the inside surface of each flange 44 and 46 so that the bottom surfaces 50 oppose each other. Note that the axis of the cylindrical openings 48 coincide with the longitudinal axis 26 of the connector 10. Each opening 48 includes a cutout 52 that provides a lead in for a hinge pin that will be described below. The cutout 52 is in the form of two diverging chamfers that extend from the end 54 of each flange into the opening 48 toward and just below the axis 26 so that the opening 48 encircles the axis 26 by an amount greater than 180 degrees thereby forming a narrow portion 55. A relief slot 56 is formed in each flange 44 and 46 so that one side of the slot is flush with the bottom surface 50. The relief slot 56 extends to a point just above the axis 26, as shown in FIG. 4. This permits a certain amount of elastic resiliency in the walls of the opening 48 so that a cylindrical pin may be forced into the cutout 52, past the narrow portion 55, causing the walls to deflect as the pin enters and then to snap back into place around the pin when the pin is fully seated within the opening.

Figure 7:
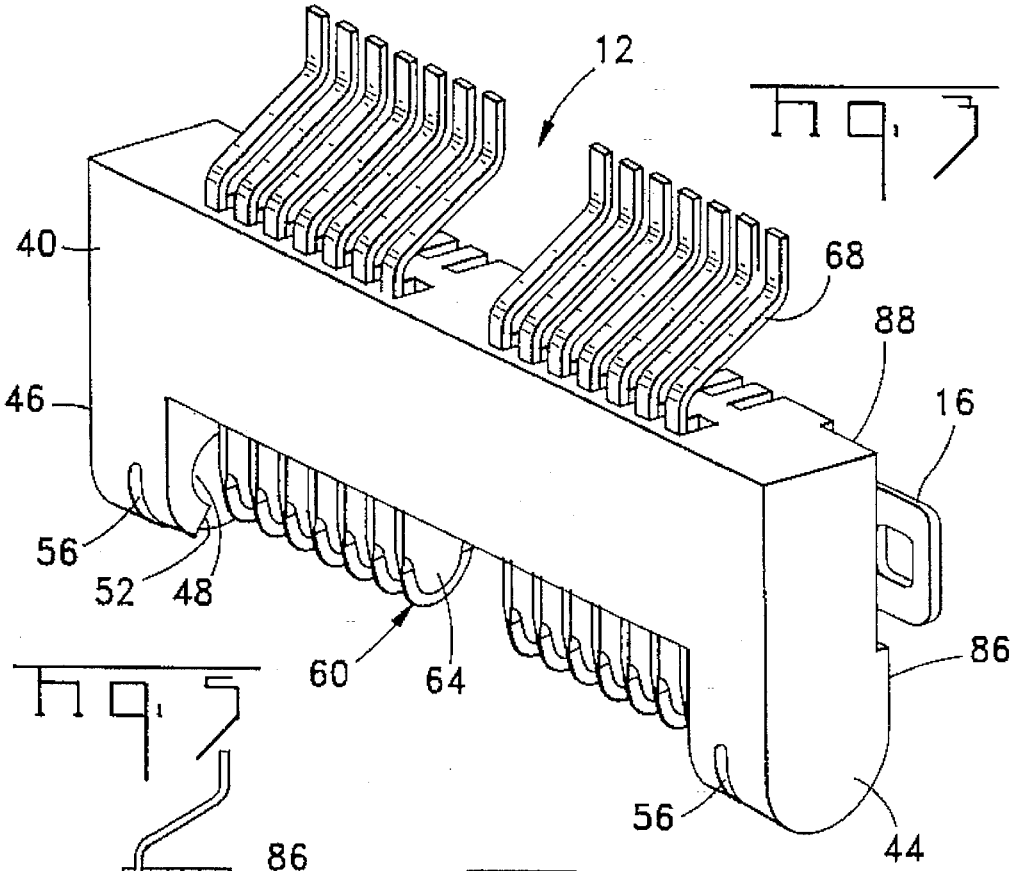
FIG. 7 is an isometric view of a plug contact shown in the plug connector of FIG. 4.
Figure 5:
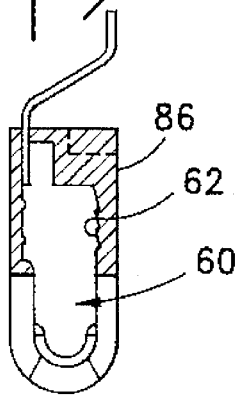
FIG. 5 is a cross-sectional view taken along the lines 5—5 in FIG. 4.
Figure 8:
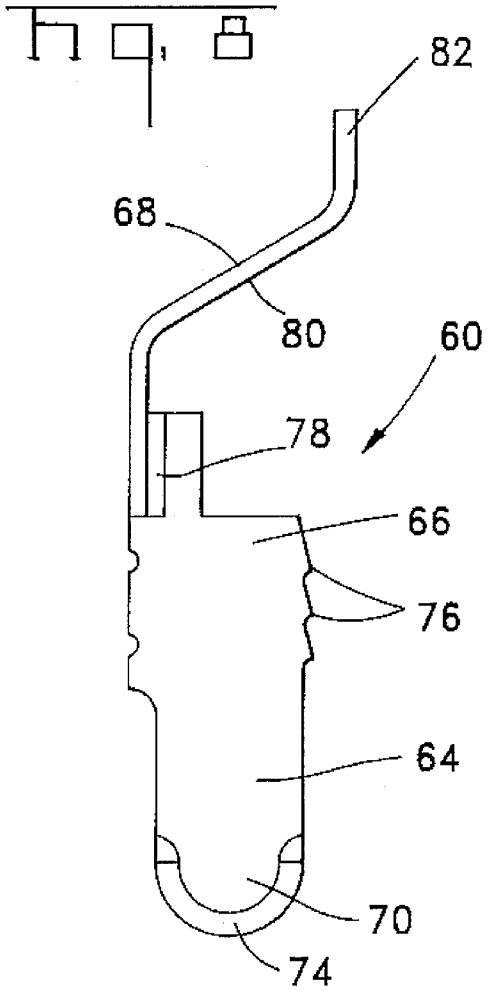
Figure 7:
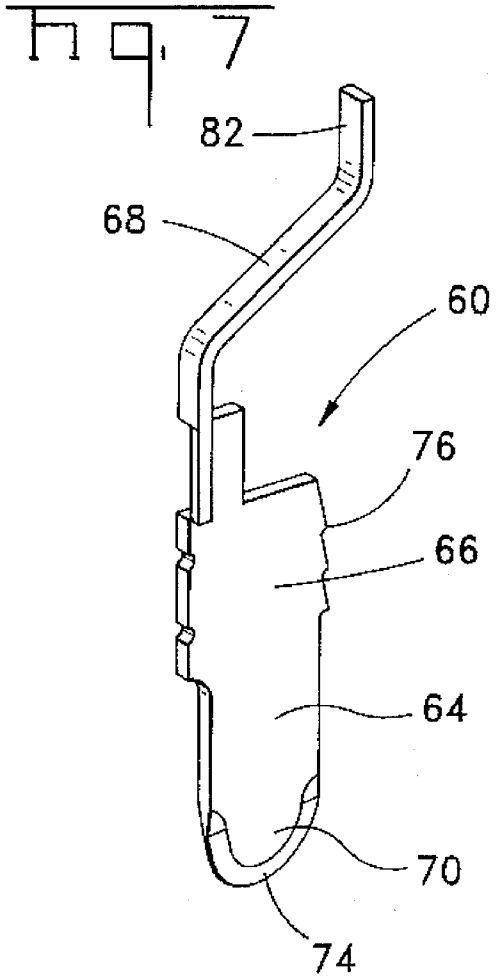
Figure 14:
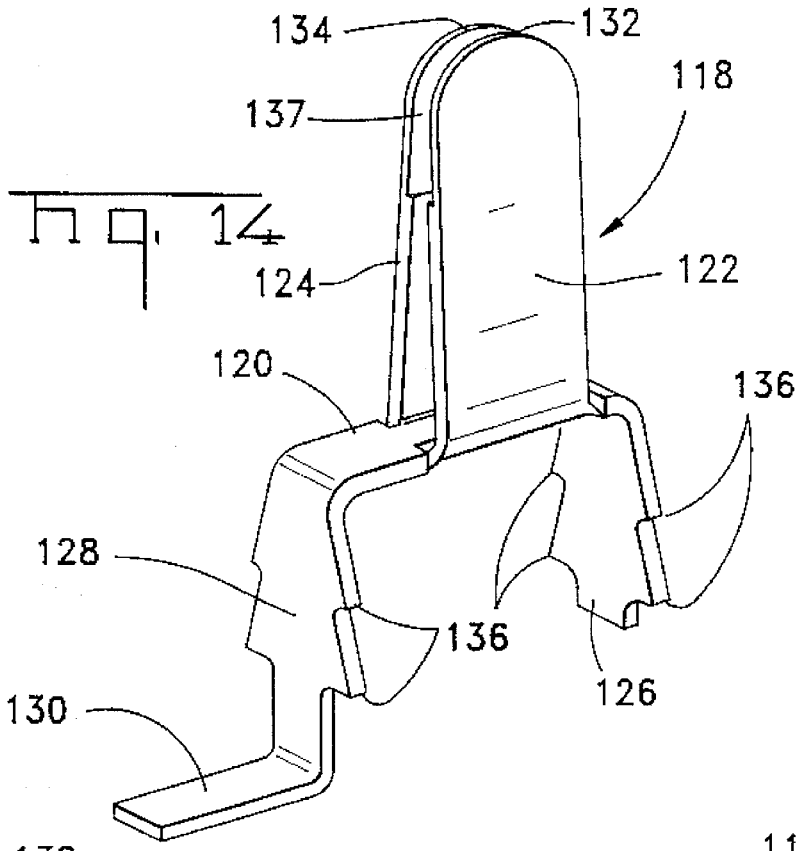
FIG. 14 is an isometric view of the receptacle contact shown in the receptacle connector of FIG. 11.
Figure 15:
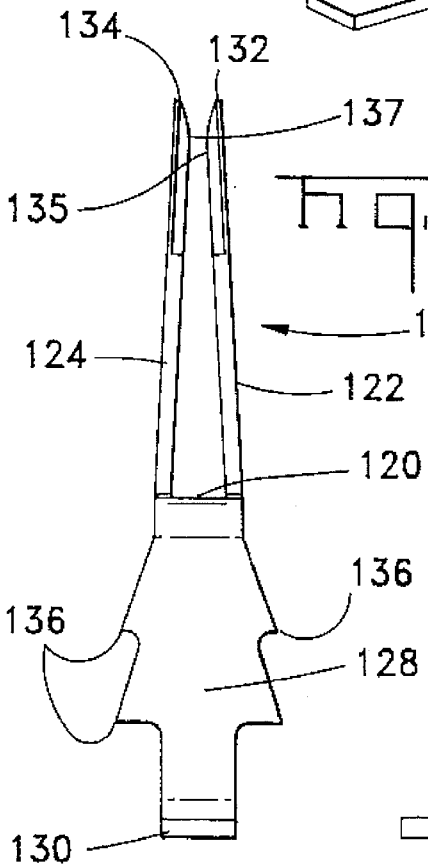
FIG. 15 is a front view of the receptacle contact.
Figure 16:
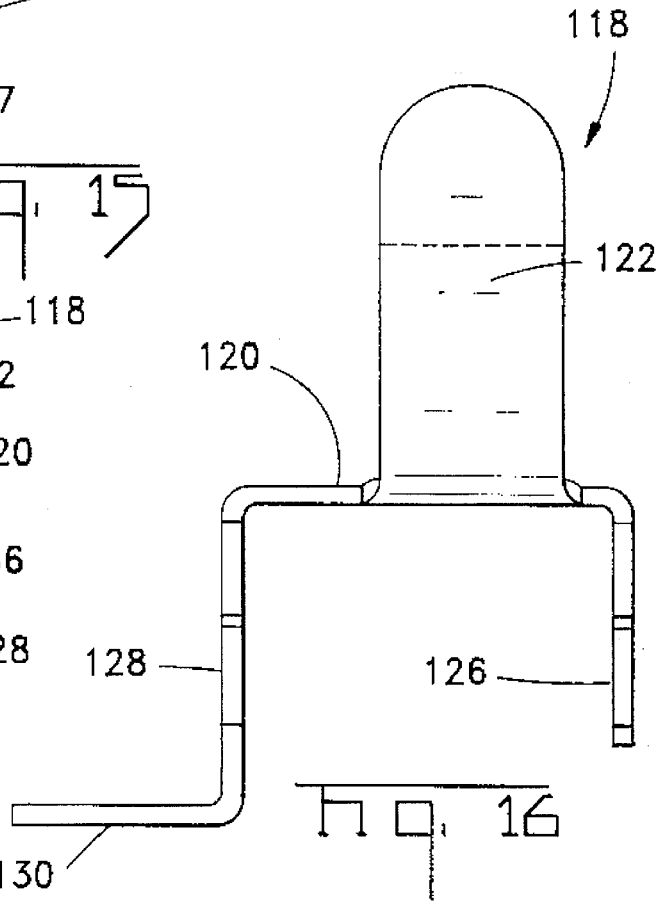
FIG. 16 is a side view of the receptacle contact.

The plug connector 12 includes a plurality of blade type contacts that are arranged in cavities 62 in the base portion 42. The blade contact 60, as shown in FIGS. 7, 8, and 9, is of unitary construction and includes a contact blade 64, a shank 66, and a tail 68, all of which are stamped and formed from beryllium copper strip stock, or other suitable material. The contact blade 64 includes two substantially flat and parallel contact surfaces 70 and 72 on opposite sides thereof. The tip of the contact blade includes a bevel 74 along the lower edge of both surfaces 70 and 72 to serve as a lead in when mating the plug connector to the receptacle connector. Several barbs 76 are formed along at least one edge of the shank 66 to secure the shank within the cavity 62 in the plug housing 40. The tail 68 extends from the end of the shank opposite the contact blade 64 from a 90 degree radiused bend 78, outwardly along an angled portion 80 and then terminating in a foot 82 that is electrically connected to circuitry on the circuit board 18, usually by soldering. The tails 68 are arranged so that their feet 82 form a relatively flat plane so that when the plug connector 12 is mounted to the circuit board 18, as shown in FIGS. 1 and 2, each foot will engage its respective circuit element on the circuit board. Each of the mounting clips 16, as seen in FIGS. 3 and 4, includes a screw hole 84 for receipt of the screw 22 and a right angled portion having barbs, not shown, that is forced into a cavity in the end of the base portion 42, in the usual manner. A bottom surface 86 of the plug housing 42 includes a recess 88 sufficiently deep to accommodate the mounting clip 16 so that the surface 86 can be very close to the mounting surface of the circuit board 18 when assembled. The receptacle connector 14, shown in FIGS. 10 through 13, has an insulating housing 100 including a base portion 102 having a mounting surface 104. The housing 100 includes a center flange 106, and a right flange 108 and a left flange 110 on either side of the center flange, all of which extend upwardly from the base portion 102. There are six intermediate flanges 112 between the center flange 106 and the right flange 108 and between the center flange and the left flange 110, as best seen in FIG. 11. However, it will be understood that the number of such flanges is not important in the practice of the present invention, nor is the need for a center flange. Each flange has a beveled surface 115 along both sides of its outer edge for a purpose that will be explained below. The flanges are spaced apart thereby defining a plug contact receiving opening 114 between each pair of adjacent flanges. There are a plurality of cavities 116 in the base portion 102, as best seen in FIG. 13, one cavity in alignment with each plug contact receiving opening 114, for receiving a receptacle contact 118. The receptacle contact 118, as shown in FIGS. 14, 15, and 16, includes a base 120, two upwardly extending contact beams 122 and 124, and two shanks 126 and 128 extending from opposite ends of the base 120 downwardly, substantially perpendicular to the base. The shank 128 terminates in a solder tail 130 that is in electrical engagement with the circuitry on the circuit board 20. The two contact beams 122 and 124, while substantially parallel, do converge slightly toward their tips 132 and 134, respectively. The opposing faces of the two contact beams 122 and 124 are contact surfaces 135 and 137, respectively, which are arranged to electrically engage the contact surfaces 70 and 72 when a plug contact 60 is in mated engagement with a receptacle contact 118. The two contact surfaces 135 and 137 are coined to form arcuate surfaces so that each surface provides a single point of contact with its corresponding plug contact surface 70, 72. The slight convergence of the two contact beams 122 and 124 assures that this single point of contact is made only on the arcuate surfaces 135 and 137. The two contact beams 122 and 124 are arranged so that the spacing of the arcuate contact surfaces 135 and 137 is slightly less than the thickness of the blade 64 of the plug contact 60. As the blade 64 is inserted between the two surfaces 135 and 137, they are cammed away from each other by the lead in chamfer 74 thereby deflecting the beams 122 and 124. When in mated position, as shown in FIG. 1, the two deflected beams provide the proper contact force at the two points of contact. Several barbs 136 are formed on the two shanks 126 and 128 which provide interference to secure the receptacle contact 118 in place when it is inserted into the cavity 116 in the receptacle housing 100, as shown in FIG. 13. As shown in FIG. 11, the receptacle housing 100 includes a central recess 138 formed in the mounting surface 104 to provide clearance for the solder tails 130 and an end recess 140 formed in the mounting surface 104 adjacent each end. The clips 16, attached to the receptacle connector in a manner similar to the plug connector, are arranged so that when mounted to the circuit board 20, as shown in FIG. 1, the mounting surface 104 is near or in engagement with the surface of the circuit board and the solder tails 130 are in electrical engagement with circuit elements on the circuit board. A cylindrically shaped hinge pin 142 extends outwardly from the right flange 108 and another cylindrically shaped hinge pin 144 extends outwardly from the left flange 110. The two hinge pins extend in opposite directions and have their axes coaxial with the axis 26 of the connector assembly 10 when the plug and receptacle connectors are mated, as shown in FIG. 1. The diameters of the hinge pins 142 and 144 are slightly smaller that the cylindrical openings 48 in the plug housing 40 but larger than the narrow portion 55 of the cutouts 52. Each of the two hinge pins 142 and 144 terminates in domed or chamfered ends 146 and 148, respectively. The distance between the two ends 146 and 148 is held to be identical to or slightly less than the distance between the two bottom surfaces 50 of the openings 48 in the plug housing 40.

In operation, the plug connector 12 is mated to the receptacle connector 14 by aligning the two bottom surfaces 50 with the two chamfered ends 146 and 148. This aligns the blades 64 of the plug contacts 60 with the openings 114 in the receptacle connector 14. The plug connector is then moved toward the receptacle connector so that the cutouts 52 capture the two ends 146 and 148 of the hinge pins 142 and 144 between the two surfaces 56. As movement continues the blades 64 enter into the openings 114 and are cammed into alignment by the beveled surfaces 115 and engage the receptacle contacts 118, the two beveled edges 74 engaging the two arcuate contact surfaces 135 and 137 and camming them apart as describe above. The hinge pins 142 and 144 engage the narrow portion 55 of the cutout 52, causing the walls to deflect just enough to permit the pins to pass into the opening 48 with a snapping action as the resiliency in the walls of the cutout cause them to return to their rest state thereby holding the two hinge pins within the openings 48. At this point each of the blades 64 of the plug contacts 60 are in full engagement with their respective receptacle contacts 118 so that the two contact surfaces 70 and 72 of the blade are in electrical engagement with their respective arcuate contact surfaces 135 and 137 of the receptacle contact. The plug connector 12 may be separated from the receptacle connector 14 by firmly pulling the plug connector in a direction that is parallel to the mounting surface of the circuit board 18, see the arrow 152 shown in FIG. 2. This procedure will work for any angular position of the plug connector within the 180 degrees indicated by the two extreme positions shown in phantom lines at 28 and 30 in FIG. 2. The shape of the cutouts 52 and resiliency of the walls are important because the narrow portion 55 serves as a retaining element to secure the plug connector to the receptacle connector during operation, yet permits separation of the two connectors.

While the plug and receptacle connectors disclosed herein utilize surface mount technology, the teachings of the present invention may be advantageously utilized in connectors having other types of mountings. Such other connectors may have leads that are inserted into plated through holes in the circuit boards, or the connectors may be edge mounted where the connector has a slot for receiving the edge of the board with contacts within the slot to engage circuitry on the board. There are many such variations that may be utilized with the present invention.

An important advantage of the present invention is that the plug connector has a pivotal range of 180 degrees within which the plug and receptacle contacts remain in mated electrical engagement. The plug and receptacle contact pairs each have two points of contact thereby increasing contact reliability under adverse operating conditions. The plug connector is easily mated to the receptacle connector and easily unmated, and both are easily installed on their respective electrical units and are reparable or replaceable in the field. The unique hinge pin and cutout arrangement provides a simple but effective way of initially aligning the plug connector to the receptacle connector during mating.

I claim:

1. A first electrical connector arranged to matingly engage a second electrical connector, said first connector comprising:

an insulating housing including a base portion having a plurality of cavities therein;

a longitudinal axis spaced from said base portion;

a plurality of contacts each having first and second contact faces for mating engagement with a respective contact of said second connector, one said contact in each said cavity extending from said base portion outwardly and arranged so that said contact faces are substantially perpendicular to and intersected by said axis;

a hinge portion having a hinge pivot coaxial with said axis and arranged so that when said first connector is in mated engagement with said second connector, said first connector is pivotable with respect to said second connector about said axis through a specific angle while continuously maintaining said mated engagement, wherein said hinge portion comprises two opposing flanges extending from said base portion of said housing on either side of said plurality of contacts, each flange including an opening having a bottom surface formed in a side thereof that is facing the other flange so that said two openings and their bottom surfaces are mutually opposed and arranged to receive hinge pins of a mating connector, said two bottom surfaces limiting relative lateral play of said hinge pins with respect to said housing of said plug connector.

2. The connector according to claim 1 wherein said first connector is a plug connector and wherein said first and second contact faces are opposite surfaces of a blade contact, said first and second faces being substantially flat and parallel.

3. The connector according to claim 1 wherein said specific angle is about 180 degrees.

4. The connector according to claim 1 wherein said first connector is a receptacle connector and each said contact includes a pair of opposing beams and said first and second contact faces are opposed surfaces of said two beams.

5. The connector according to claim 4 wherein said first and second contact faces are arcuate and each face being arranged to electrically engage a mating plug contact at a single point.

6. The connector according to claim 4 wherein said housing includes a right flange, a left flange, and at least one intermediate flange between said left and right flanges, all said flanges extending upwardly from said base portion and being spaced apart thereby defining a plug contact receiving opening between each pair of adjacent flanges, said plurality of cavities arranged so that each plug contact receiving opening has a respective said cavity in alignment therewith.

7. The connector according to claim 6 wherein each flange has a beveled surface along both sides of its outer edge.

8. An electrical plug and receptacle connector assembly having a plug connector and a receptacle connector in mated engagement and arranged so that said plug is pivotable with respect to said receptacle about a longitudinal axis while maintaining electrical mating engagement thereof comprising:

insulating plug and receptacle housings each of which includes a base portion having a plurality of cavities therein, wherein said longitudinal axis is spaced from said base portions;

a plurality of blade contacts each having first and second opposite and substantially flat contact faces, one said contact in each said cavity of said plug housing extending from said base portion thereof outwardly and arranged so that said contact faces are substantially perpendicular to and intersected by said axis;

a plurality of receptacle contacts each having first and second opposing contact faces for mating engagement with a respective blade contact of said plug connector, one said contact in each said cavity of said receptacle housing extending from said base portion thereof outwardly and arranged so that said contact faces are intersected by said axis;

a hinge having a hinge pivot coaxial with said axis and arranged so that when said plug connector is in mated engagement with said receptacle connector, said plug connector is pivotable with respect to said receptacle connector about said axis through a specific angle while continuously maintaining said mated engagement, wherein said hinge comprises two opposing flanges extending from said base portion of one of said plug and said receptacle housings on either side of said plurality of said contacts, each flange including an opening having a bottom surface formed in a side thereof that is facing the other flange so that said two openings and their bottom surfaces are mutually opposed, and a pair of pins projecting from opposite ends of the other of said plug and receptacle housings arranged to pivotally engage said two openings when said plug and receptacle connectors are in mated engagement, said two bottom surfaces spaced so that the ends of said two hinge pins disposed within said openings abut their respective bottom surface thereby limiting relative lateral play.

9. The connector assembly according to claim 8 wherein said specific angle is about 180 degrees.

10. The connector assembly according to claim 9 wherein each said opening in said flanges includes a cutout extending from an end of said flange toward but short of said axis so that said opening encircles said axis by an amount greater than 180 degrees thereby forming a narrow portion having opposing walls that tend to retain said pin within said opening.

11. The connector assembly according to claim 10 wherein each said cutout includes a chamfer in each of said opposing walls thereby forming a lead in to said narrow portion so that during mating of said plug connector to said receptacle connector said hinge pins engage said chamfers causing said walls of said narrow portions to deflect so that said pins pass into said openings.

12. The connector assembly according to claim 11 wherein each of said two flanges includes a relief slot formed flush with said bottom surface that permits elastic deflection of said walls of said narrow portion during said mating.

13. The connector assembly according to claim 1 wherein each said opening in said flanges includes a cutout extending from an end of said flange toward but short of said axis so that said opening encircles said axis by an amount greater than 180 degrees thereby forming a narrow portion having opposing walls that tend to retain said pin within said opening.

14. The connector assembly according to claim 13 wherein each said cutout includes a chamfer in each of said opposing walls thereby forming a lead in to said narrow portion so that during mating of said plug connector to said receptacle connector said hinge pins engage said chamfers causing said walls of said narrow portions to deflect so that said pins pass into said openings.

15. The connector assembly according to claim 14 wherein each of said two flanges includes a relief slot formed flush with said bottom surface that permits elastic deflection of said walls of said narrow portion during said mating.

* * * * *